United States Patent [19]

Hayskar

[11] 3,944,121

[45] Mar. 16, 1976

[54] BOOKBINDER WITH A DAMPED-ADHESIVE STRIP INSERTER

[75] Inventor: Robert A. Hayskar, Palatine, Ill.

[73] Assignee: Xerox Corporation, Stamford, Conn.

[22] Filed: Sept. 26, 1974

[21] Appl. No.: 509,580

[52] U.S. Cl. ..... 226/136; 226/148; 226/156

[51] Int. Cl.[2] ..... B65H 17/22

[58] Field of Search ..... 226/13, 38, 60, 61, 147, 226/148, 156, 136

[56] References Cited

UNITED STATES PATENTS

| | | | |
|---|---|---|---|
| 3,207,400 | 9/1965 | Halberg | 226/136 |
| 3,540,644 | 11/1970 | Schliefenbaum | 226/136 |

*Primary Examiner*—Richard A. Schacher

[57] ABSTRACT

Apparatus of the type wherein a desired length of adhesive strip is fixed to an edge of a stack of sheets with heat and pressure includes automatic means for reliably providing the desired length of strip from a roll of adhesive strip. The automatic means include a pair of rollers which engage and feed strip, one of the rollers being mounted for free rotation and the other of the rollers being coupled to a shaft by a one-way clutch. Means rotate the shaft from a start-of-feed position a selectable amount in one direction, with said other roller and clutch engaged, to feed the desired length of strip and, thereafter, a spring counter rotates the shaft to the start-of-feed position, said position being determined by an abutment which limits rotation of a gear coupled to the shaft. A flywheel frictionally coupled to the shaft prevents bounce when the abutment limits rotation of the gear, thereby preventing rotation of the shaft in said one direction and, consequently, unmetered feeding of adhesive strip.

6 Claims, 9 Drawing Figures

BOOKBINDER WITH A DAMPED-ADHESIVE STRIP INSERTER

BACKGROUND OF THE INVENTION

The subject invention relates to mechanism for paying out predetermined lengths or sections of sheet type materials and in particular to a mechanism for feeding to apparatus for binding books predetermined lengths of adhesive bearing binding strips.

PRIOR ART

U.S. pat. applications 474,840 and 474,839, filed on May 30, 1974 by R. J. Kuhns, and U.S. pat. applications 474,510 and 474,841, filed on May 30, 1974 by E. Sarring, disclose bookbinding apparatus which automatically applies a length of adhesive bearing strips to a stack of sheets to form a book. In said apparatus the length of strip to bind a stack of sheets may be provided by an automatic strip inserter such as is described in U.S. pat. application 393,583, filed by R. J. Kuhns on Aug. 29, 1973.

Briefly, the automatic strip inserter disclosed by R. J. Kuhns includes a pair of contacting rollers into the nip of which an end of a roll of adhesive strip is inserted. One of the rollers is connected by a one-way clutch to a rotatably mounted shaft such that rotation of the shaft in one direction rotates the roller, thereby feeding strip, and rotation of the shaft in the other direction has no effect on the rollers. Rotation of the shaft in said one direction is achieved with a first gear rigidly mounted on the shaft; a second gear, engaged with the first gear, rotatably mounted on a drive shaft coupled to a motor; detent means fixed to the second gear; and a member, fixed to the drive shaft, which is engagable with the detent means. A tension spring coupled to the roller shaft normally maintains the detent means against an abutment and when the motor is actuated by a timing circuit the member engages and moves the detent means away from the abutment. In the process, the second gear is rotated and the adhesive strip is fed. Rotation of the second gear continues until a projection thereon strikes a stop on a metering wheel and causes the member to disengage from the detent means. Additional tension is provided to the spring during said rotation of the second gear and as a result, when the detent means and member disengage, the first gear drives the second gear in the opposite direction. Thus, since rotation of the roller shaft in the opposite direction does not move the roller, the length of strip fed is dependent upon the angular displacement between the abutment and the stop. When the tension spring drives the detent means against the abutment the inertia provided causes the detent means to bounce away from the abutment with a magnitude and frequency which is dependent on the angular displacement of the second gear and, since with each bounce the clutch moves the roller, some undesired and generally unknown quantity of strip is added to the length determined by a setting of the metering wheel.

In bookbinding it is generally desired that the binding strips be coextensive with the edge of a stack of sheets to be bound. Since the undesired length described above is variable and generally indeterminate, if the R. J. Kuhns inserter is used in the referenced bookbinding apparatus, the apparatus provides books having excessive strip, extending from the bound edges, which is objectionable.

SUMMARY OF THE INVENTION

It is an object of the present invention to provide improved bookbinding apparatus wherein books manufactured thereby include a binding strip of acceptable length.

It is another object of the present invention to provide apparatus for reliably paying out predetermined lengths of sheet material such as adhesive strip.

Briefly, the invention herein sets forth apparatus for providing a metered length of adhesive bearing strip, from a supply roll of adhesive bearing strip, to a mechanism for fixing the metered length of adhesive bearing strip to an edge of a stack of sheets. The apparatus includes: (a) a first roller rotatably coupled to the mechanism; (b) a second roller coupled by a one-way clutch to a shaft rotatably coupled to the mechanism, the adhesive bearing strip being engagable with a nip provided by the first and second rollers; (c) abutment means for limiting rotation of the shaft from a start-of-feed position to a direction which causes engagement with the one-way clutch; (d) drive means for rotating the shaft to drive the second rollers a predetermined amount, thereby providing the metered length of adhesive bearing strip when said strip is loaded in the nip; (e) spring means responsive to the drive means for rotating the shaft in the opposite direction after the roller has been driven said predetermined amount; and (f) means for applying a torque, to prevent the shaft from reversing its direction, when the spring induced motion is limited by the abutment means.

BRIEF DESCRIPTION OF THE DRAWINGS

Additional objects and features of the invention will become apparent by reference to the following description in conjunction with the accompanying drawings, in which.

DESCRIPTION OF A PREFERRED EMBODIMENT

Figures 1, 2:
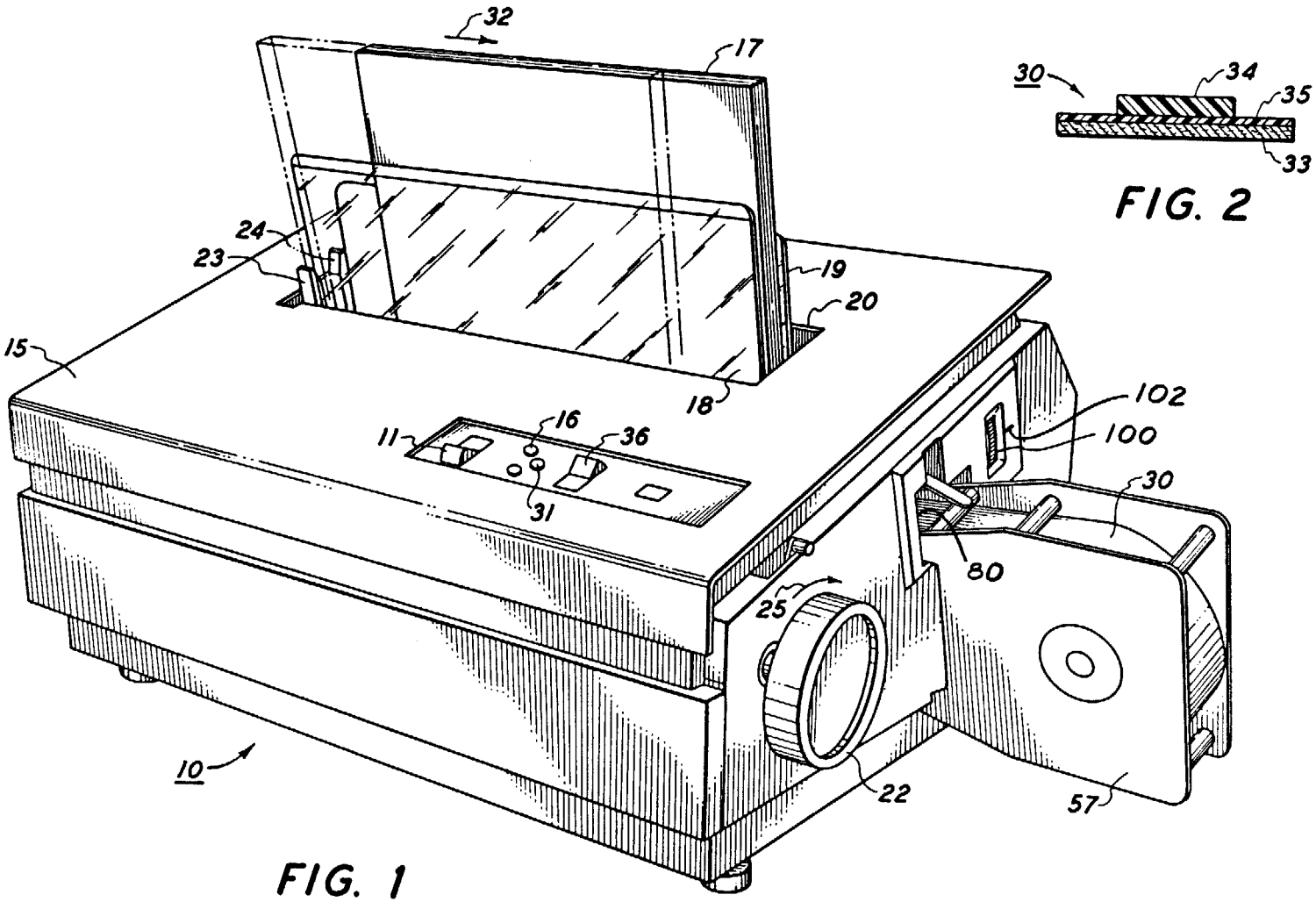
FIG. 1 is a perspective view of a bookbinding machine which includes the subject invention.
FIG. 2 shows a cross-sectional view of an adhesive strip usable with the machine to bind a stack of paper sheets.

FIG. 1 shows a perspective view of a bookbinding machine 10 which embodies the subject invention. Machine 10 is capable of applying an adhesive bearing substrate of suitable length and width to an edge of a stack of paper sheets, thereby making a book. A functional description of how machine 10 operates is set forth below, a more detailed description thereof having been disclosed in U.S. patent applications 474,840 and 474,839, filed May 30, 1974 by R. J. Kuhns, and U.S. patent applications 474,510 and 474,841, filed May 30, 1974 by E. Sarring.

Figure 3:
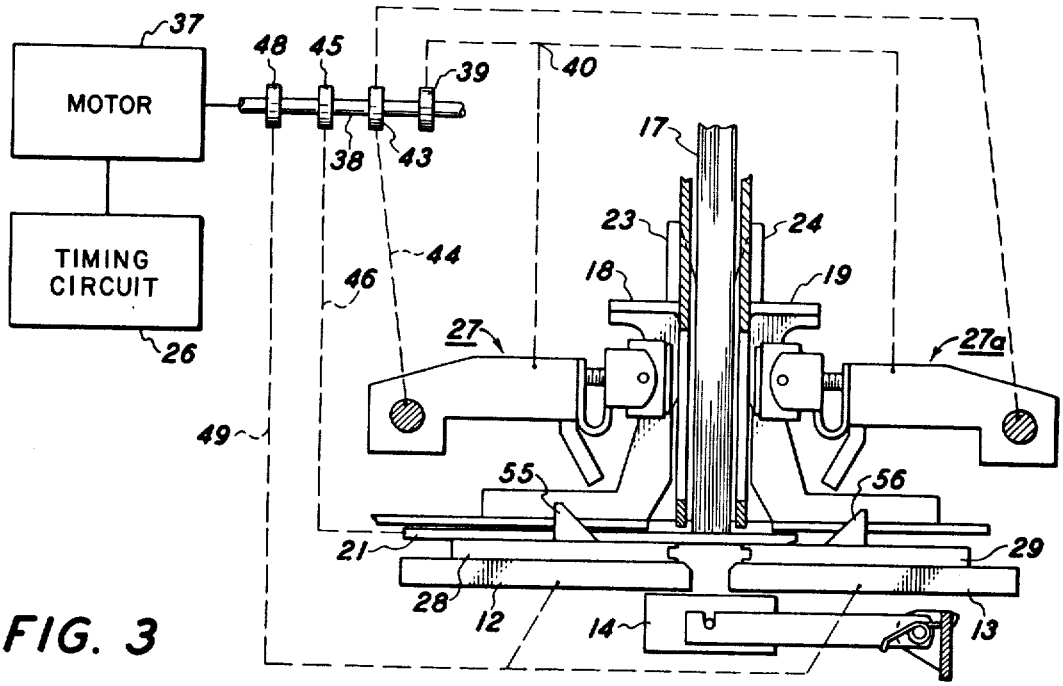
FIGS. 3–7 diagramatically show parts of the machine and their general movement during a binding cycle of the machine.

Referring to FIGS. 1 and 3, in the operation of machine 10 once a power switch 11 is actuated platens 12–14 within the housing 15 of the machine are heated with heating coils (not shown). Monitoring means (not shown) measure the temperature of the platens and when they reach a predetermined temperature an indicator light 16 turns on, thereby indicating that the machine is ready to perform a bookbinding cycle. To make a book a stack of paper sheets 17 to be bound is initially placed between page guides 18 and 19 at the extreme left end of the elongated slot 20 in the housing 15 (see dotted lines in FIG. 1). In this position, the pages rest on a movable plate 21 within the housing. The knob 22 is coupled to the page guides by a slip clutch and linkage such that rotation of the knob in the direction of the arrow 25 causes the page guides 18 and 19 to be moved toward each other until a pair of caliper members 23 and 24 mounted on page guides 18 and 19, respectively, abut and compress the stack of paper sheets 17. Thereafter, because of the resistance offered by the compressed stack of paper sheets and the use of a slip clutch, further rotation of the knob in the direction of arrow 25 has no effect on the spacing between the page guides 18 and 19 and the caliper members 23 and 24. Simultaneously with the movement of the page guides 18 and 19 and the caliper members 23 and 24 toward each other, rotation of the knob 22 in the direction of arrow 25 brings the heated platens 12 and 13 (see FIG. 3) toward each other and, therefore, the space between the platens 12 and 13 is determined by the thickness of the compressed stack of paper sheets. The latter is significant because such a setting of the distance between platens 12 and 13 permit their use in the binding of stacks of different thicknesses with only a slight additional movement of the platens during a subsequent part of the binding process. A linear clutch arrangement, shown in the referred applications, holds the page guides 18 and 19 and platens 12 and 13 in the position described while rotation of the knob 22 in the opposite direction moves bipartite means 27 and 27*a*, for clamping the stack of paper sheets 17, into position for clamping and moves strip guides 28 and 29 into a position (see FIG. 3) for receiving a suitable length of an adhesive bearing strip 30.

After calipering, as described above, the stack of paper sheets 17 are moved, as indicated by arrow 32 in FIG. 1, to the extreme right of elongated slot 20 and actuate sensing means (not shown) which turn an indicator light 31 on if a cartridge 57 having an adhesive strip, of suitable width, for binding is operatively engaged with machine 10.

As disclosed by the cross-sectional view of strip 30 (FIG. 2), the adhesive bearing strip 30 comprises a formable substrate 33 of, typically, relatively heavy paper stock, and adhesive coatings 34 and 35. Adhesive coatings 34 and 35 constitute a plurality of strip-like formations comprising two heat activated adhesive types. Heat activated adhesives may be either of the low or high tack types. A low tack adhesive comprises an adhesive material which when heated becomes fairly molten or fluid, thereby providing a high degree of surface wet-out with a minimum application of pressure or heat. A typical low tack adhesive may be a mixture of about 80 percent by weight of an ethylene/vinyl acetate copolymer having a 90 percent ratio of ethylene to vinyl acetate and about 20 percent by weight of rosin acid ester. A high tack adhesive comprises an adhesive material which when heated remains highly viscous and somewhat immobile so that a definite amount of heat is necessary to wet-out a surface being adhered. A typical high tack adhesive may be a mixture of polyethylene, a rosin acid, and a metal salt of a carboxylic acid, present in weight proportions of 80/10/10, respectively. High tack adhesives have the advantage that, on application of heat and pressure, the bond created thereby immediately possesses a high degree of strength. On the other hand, the low tack adhesives have the advantage that on application of heat and pressure the adhesive flows readily or is wicked into the edges of the paper sheets to be bound. The strip 30 preferably has the high tack adhesive 35 uniformly applied to the substrate 33 while the low tack adhesive 34 is applied along the center line of the substrate with a relatively greater thickness than that of the high tack material. Typically, the width of the adhesive 34 is approximately equal to or slightly greater than the overall compressed thickness of the stack of sheets to be bound. For a more detailed description of the strip reference may be had to a U.S. patent application, Ser. No. 196,446, filed Nov. 1, 1971, by Donald W. Watson.

Figure 4:
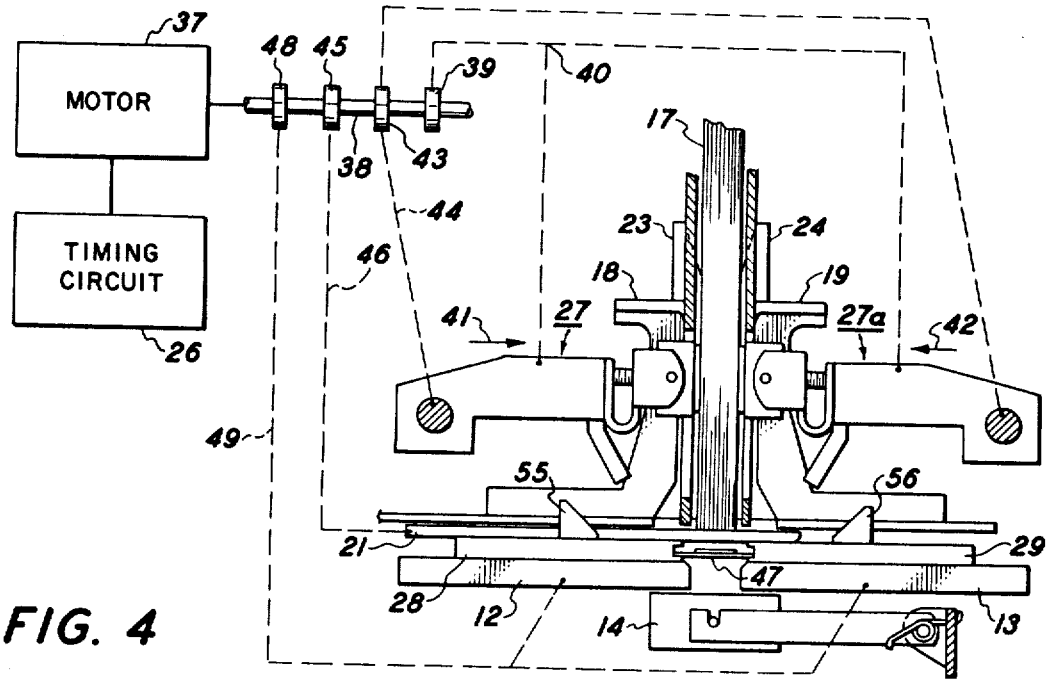
Figure 5:
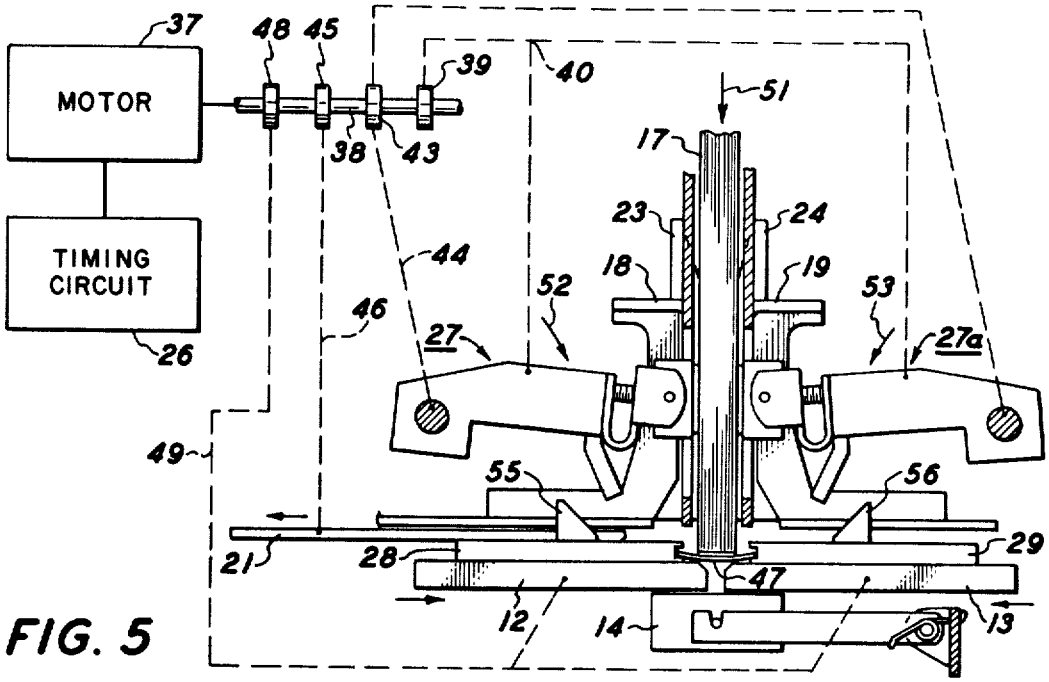
Figure 6:
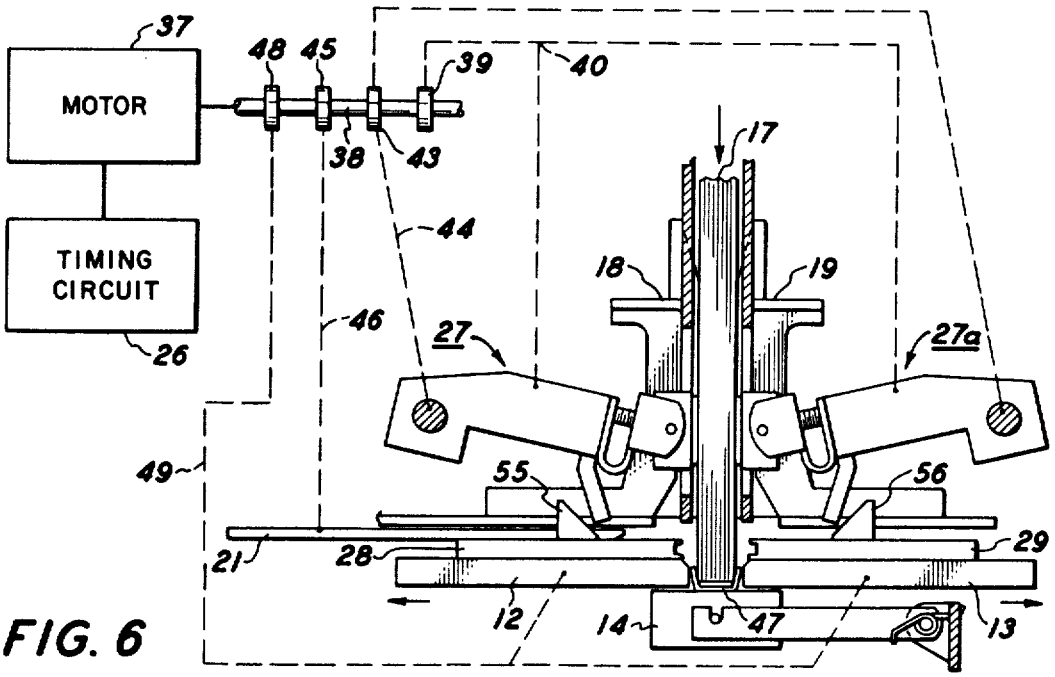
Figure 7:
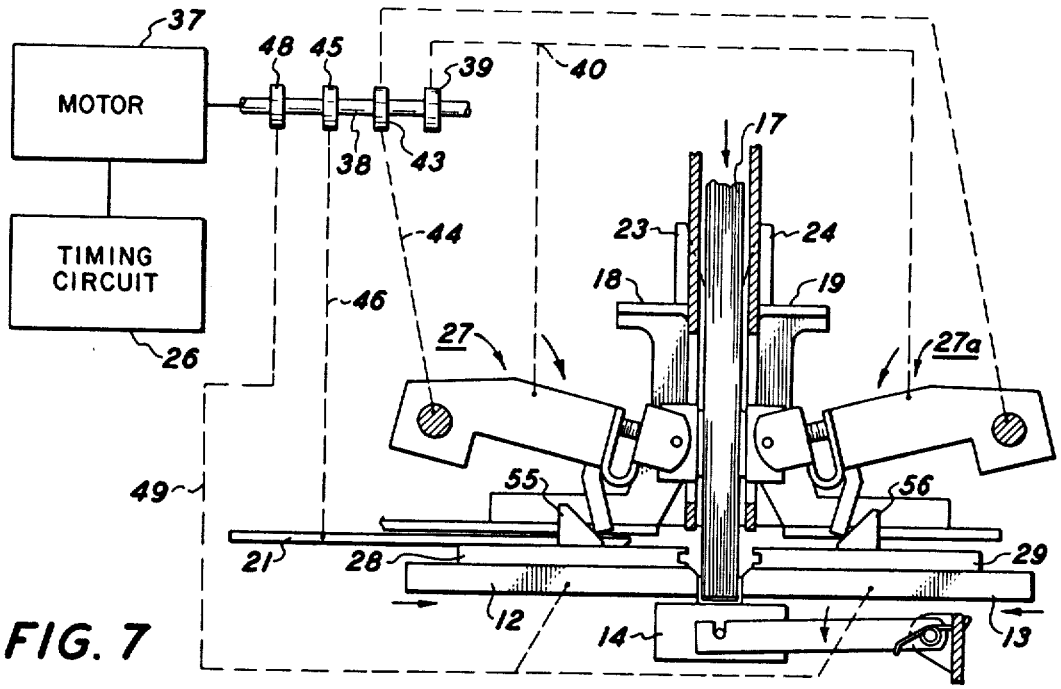

Referring again to FIG. 1, with suitable adhesive strip in the cartridge, actuation of a "blind button" 36 initiates an automatic binding cycle. More specifically, when button 36 is pressed a main drive motor 37 (see FIG. 3) is energized and rotates a main drive shaft 38 of the apparatus. A cam 39 carried by the main drive shaft effects movement of suitable linkage 40 resulting in movement of the clamping means 27 and 27*a* as indicated by arrows 41 and 42 in FIG. 4 and clamping of the stack of paper sheets 17. To this end, the page guides 18 and 19 are provided with suitable openings through which part of the clamping means move. After clamping, the main drive motor 37 is automatically de-energized by a timing circuit 26 for a predetermined period of time and a motor of a strip inserter, more fully described below, is actuated to insert a measured section 47 of strip 30 into the channel-shaped guides 28 and 29. Upon re-energization of the motor 37 a cam 43 carried by shaft 38 drives linkage 44, thereby rotating the clamping means and lifting the stack of paper sheets 17 from the movable plate 21 enough so that the plate 21 can be retracted from its page holding position by a cam 45 carried by the shaft 38 and connected by linkage 46 to the plate. Thereafter, the stack of paper sheets 17 can be plunged or moved in the direction of the heated platens 12–14. Referring to FIG. 5, simultaneously with the retraction of the plate 21 (see arrow 50), the lifting of the stack of paper sheets 17, and subsequent movement, as indicated by arrows 51–53, of the sheets downward, the platens 12 and 13 are moved toward each other by a cam 48 on shaft 38 and linkage 49 (see arrows 54 and 58). The cams 39 and 48 are designed to bring the stack of paper sheets into abutment with the strip section 47 and to move strip section 47 against the heated platens 12 and 13. Strip section 47 remains in contact with the top surfaces of the heated platens 12 and 13 for a period of time sufficient to effect preheating and softening thereof. After strip section 47 has been heated, the cams 43 and 48 effect a slight lifting of the stack of paper sheets and a separation of platens 12 and 13 sufficient to snugly accommodate the thickness of the compressed stack of sheets and the strip section. The stack of paper sheets 17 are then moved downwardly (see FIG. 6) and press strip section 47 into contact with heated and resiliently mounted bottom platen 14. Thereafter, platens 12 and 13 are biased against the strip section for a period of time sufficient to soften the high tack adhesive, thereby fixing the strip section to the sides of the stack of sheets. After the high tack adhesive has been softened the platens 12 and 13 are partially opened and "Cooking" of the low tack adhesive continues for a predetermined period of time. During this period the main motor is stopped by the timing circuit 26. Subsequently, the main motor is again energized and platens 12 and 13 are fully opened by cam 48 and linkage 49. Sequentially, the resulting book is then lifted to a position slightly above plate 21, plate 21 is returned to its book supporting position, and the resulting book is moved downwardly until it rests on the plate. Thereafter, the clamping means 27 and 27*a* are retracted from engagement with the book and the main motor is deenergized. The bound book can now be removed from the binding apparatus. It should be noted that in this plunge of the stack of paper sheets the clamping means are brought against abutment means 55 and 56 mounted on strip guides 28 and 29, respectively. Further, abutment means 55 and 56 are sloped to limit the plunge in proportion to the thickness of the stack of paper sheets. With this arrangement platens 12 and 13 always fix edge sections of the strip section against the sides of the stack of paper sheets and, consequently, a single width of strip section can be used to bind a stack of paper sheets within a predetermined thickness range.

Figure 8:
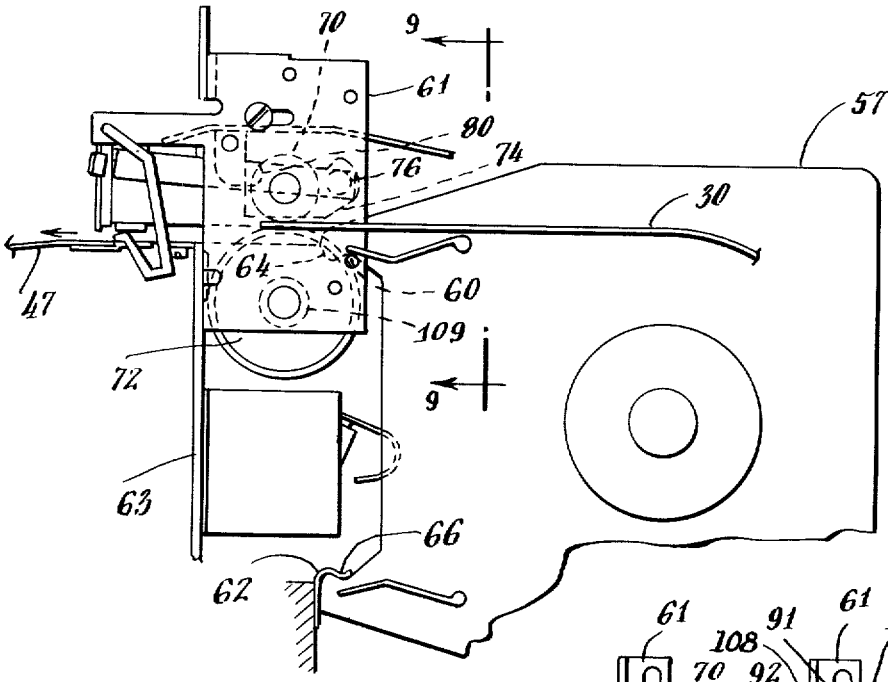
FIG. 8 is a side elevational view of the cartridge shown in FIG. 1 together with a side elevational view of apparatus, according to the invention, for providing from a roll contained in the cartridge a metered length of adhesive strip.

The strip inserter advances a predetermined length of adhesive bearing strip from the cartridge 57 into the channel-shaped guides 28 and 29 and cutting means, such as disclosed in U.S. patent application 392,583 by R. J. Kuhns cut and complete the insertion of the length of strip 47 into the guides. Structurally, as disclosed in FIG. 8, the cartridge 57 containing the adhesive bearing strip 30 is removably mounted to the housing 15 by means of a rod 60 fixed by a bracket 61 to a frame plate 63 and a spring clip 62 attached to the housing 15. To this end, the rod 60 and spring clip 62 cooperate with pairs of lip portions 64 and 66 of the cartridge. As can be seen from a consideration of FIG. 8, the cartridge 57 is mounted so that its upper portion is aligned with the nip 68 formed by an upper feed roller 70 and a lower feed roller 72 of the strip inserter. With this arrangement, the leading edge of the adhesive bearing strip 30 can be conveniently threaded into the nip 68 and permits optimum feeding of the adhesive bearing strip from the cartridge to the guides 28 and 29.

To facilitate the threading of the adhesive bearing strip the upper feed roller 70 is mounted such that it can be temporarily moved out of engagement with the lower feed roller 72. To this end, the upper feed roller is rotatably carried by the central part of a U-shaped support member 74 and the support member is pivotably secured at its ends to a pin member 76 carried by bracket 61. A lever arm 80 extending outwardly from the housing 15 through an opening 82 (shown in FIG. 1) includes a finger engagable with support member 74 and serves to lift the upper roller 70 out of its engagement with the lower roller 72 through movement of the lever in an upward direction, suitable biasing means, such as a spring (not shown), being provided for returning the upper feed roller to its nip forming position with the lower feed roller.

Figure 9:
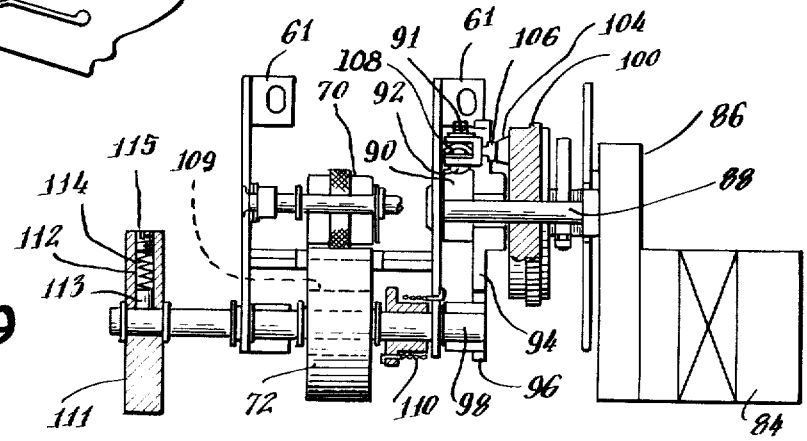
FIG. 9 is a side plan view of the apparatus taken along lines 9—9 in FIG. 8, portions thereof having been broken away to more fully illustrate the invention.

In FIG. 9 there is disclosed additional parts of the strip inserter, among which are a strip feed motor 84 and a gear box 86, the latter of which houses suitable gears for providing speed reduction and control of an output shaft 88 from the gear box 86. A driving lever 90 is carried approximate the end of the shaft 88 such that it can engage a detent member 92 carried by a drive gear 94. The gear 94 serves to drive a driven gear 96 supported by shaft 98 and shaft 98 is coupled via a one-way clutch 109 to the lower feed roller 72. Therefore, when the output shaft 88 rotates and clutch 109 is engaged the lower feed roll 72 also rotates to thereby feed adhesive bearing strip.

In accordance with the objects of the present invention, it is desired to reliably feed or meter different lengths of adhesive bearing strip depending on the length of an edge on a stack of sheets which is to be bound into a book. Accordingly, adjustable feed is accomplished by the provision of a metering mechanism including a metering wheel in the form of a thumb actuatable wheel 100 which protrudes through one side wall of the housing 15 (FIG. 1) to permit setting thereof in accordance with indicia (not shown) on its periphery which is aligned with an index mark 102 on the aforementioned side wall.

The metering wheel carries a stop member 104 on one face (i.e., to the left as viewed in FIG. 9) which stop serves as a fixed abutment engagable by a sidewardly projecting pin member 106 carried by the drive gear 94. For this purpose, means, such as a pawl fixed to bracket 61 and engagable ratchet teeth on the wheel (not shown), are provided to prevent the metering wheel from rotating in the counterclockwise direction, as viewed from the right in FIG. 9, once the wheel has been manually set in accordance with the desired length of adhesive strip to be metered. In operation, when motor 84 is actuated lever 90 engages and rotates the detent member away from an abutment 91, thereby rotating gear 94 until stop member 104 engages pin 106. Engagement of the stop member 104 by the sidewardly projecting pin member will cause the driving lever 90 to move the detent member against the bias of a bellville washer 108 which allows the driving lever to move past the detent to thereby effect disconnection of the driving coupling therebetween to terminate rotation of the lower feed roller 72, which, as will be appreciated, terminates the feed of adhesive bearing strip.

During feeding of the adhesive bearing strip, a spring member 110, secured at one end to the shaft and at its other end to bracket 61, is tensioned through clockwise rotation, as viewed from the right in FIG. 9, of the shaft 98. Once the feeding has stopped and the strip material has been cut the spring functions to reposition the sidewardly extending pin member 106 to its "start-of-feed position" through rotation of the gears 90 and 94. During repositioning clutch 109 is disengaged from roller 72 and roller 72 is not driven. It will be appreciated that the relative angular distance between the pin member 106 and the stop member 104 determines the length of strip material that is fed during one cycle of operation. It will also be appreciated that the length of the strip material fed can be varied by changing the aforementioned arc angular distance length which, in this embodiment, is accomplished by setting of the metering wheel.

Shaft 98 rotatably carries a disc-like flywheel 111 which includes a radial bore 112 having a threaded peripheral end section. In the bore there is slidably located a Delrin plug 113, a spring 114, and a set screw 115 engaged with the threaded end section to press the spring against the plug. Plug 113 abuts shaft 98 and the frictional force therebetween is determined by the depth to which the set screw 115 is inserted. Thus, a spring loaded Delrin plug permits the flywheel to turn on shaft 98 with an adjustable degree of slip. As previously mentioned, during the process of feeding spring member 110 is tensioned and this tension drives gears 96 and 94. However, during this process energy stored in the spring member is partially absorbed by the starting inertia of the flywheel 111 and when detent member 92 moves against abutment 91 the rotational inertia of the flywheel causes the flywheel to over-travel. The over-travel provides a torque which prevents rebounding of the detent member. Since clutch 109 would cause adhesive strip to be advanced if the detent member bounced and rotated gear 94, it may be seen that the flywheel eliminates unmetered feeding of the adhesive bearing strip. Although Delrin has been selected in this embodiment because of its properties, e.g., eliminates any need to lubricate the shaft and is insensitive to humidity, it should be noted that other materials may be used to provide a frictional engagement with the shaft 98. Moreover, it should be noted that the frictional force between the plug and the shaft may be varied to optimally damp the return of the detent member and, consequently, roller 72, when the automatic strip feeding apparatus is assembled and when plug 113 wears down.

It is to be understood that the description herein of a preferred embodiment, according to the invention, is set forth as an example thereof and is not to be construed or interpreted as a limitation on the claims which follow and define the invention.

What is claimed is:

1. Apparatus for providing a metered length of adhesive bearing strip, from a supply roll of adhesive bearing strip, to a mechanism for fixing the metered length of adhesive bearing strip to an edge of a stack of sheets, comprising:

a. a first roller rotatably coupled to the mechanism;

b. a second roller coupled by a one-way clutch to a shaft rotatably coupled to the mechanism, the adhesive bearing strip being engagable with a nip provided by the first and second rollers;

c. abutment means for limiting rotation of the shaft from a start-of-feed position to a direction which causes engagement with the one-way clutch;

d. drive means for rotating the shaft to drive the second rollers a predetermined amount, thereby providing the metered length of adhesive bearing strip when said strip is loaded in the nip;

e. spring means responsive to the drive means for rotating the shaft in the opposite direction after the roller has been driven said predetermined amount; and f. means for applying a torque, to prevent the shaft from reversing its direction, when the spring induced motion is limited by the abutment means.

2. Apparatus as defined in claim 1 wherein said means for applying a torque includes means frictionally coupled to the shaft.

3. Apparatus as defined in claim 2 wherein said means frictionally coupled to the shaft include: a member rotatably mounted on the shaft, said member having a hole communicating with the shaft; a plug slidably mounted in the hole; and means for biasing the plug against the shaft.

4. Apparatus as defined in claim 3 wherein said hole includes a threaded section and wherein said means for biasing the plug include a spring and a threaded member engated with the threaded section for compressing the spring against the plug, thereby creating frictional engagement between the plug and shaft.

5. Apparatus as defined in claim 4 wherein said member is a disc; wherein the axis of said hole extends radially away from the shaft; and wherein the plug, the spring and the threaded member are aligned with said axis.

6. Apparatus as defined in claim 4 wherein the drive means include: a driven gear coupled to the shaft; a drive gear having a projecting member; means responsive to the mechanism for engaging and driving the drive gear through a predetermined angular displacement and thereafter releasing the drive gear for return by the spring means, during which return the projecting member is brought into contact with the abutment means to limit rotation of the shaft.

* * * * *